US010173753B1

(12) United States Patent
Olsson et al.

(10) Patent No.: US 10,173,753 B1
(45) Date of Patent: Jan. 8, 2019

(54) FLOTATION DEVICES FOR HIGH PRESSURE ENVIRONMENTS

(71) Applicant: DeepSea Power & Light, Inc., San Diego, CA (US)

(72) Inventors: Mark S. Olsson, La Jolla, CA (US); Ray Merewether, La Jolla, CA (US)

(73) Assignee: SEESCAN, INC., San Diego, CA (US)

( * ) Notice: Subject to any disclaimer, the term of this patent is extended or adjusted under 35 U.S.C. 154(b) by 403 days.

(21) Appl. No.: 13/668,640

(22) Filed: Nov. 5, 2012

Related U.S. Application Data

(60) Continuation-in-part of application No. 12/483,140, filed on Jun. 11, 2009, now abandoned, which is a division of application No. 11/220,500, filed on Sep. 7, 2005, now abandoned.

(51) Int. Cl.
*B63B 5/00* (2006.01)

(52) U.S. Cl.
CPC ..... *B63B 5/00* (2013.01)

(58) Field of Classification Search
CPC ..... B63B 5/00; B63B 2231/50; B29C 70/66; C08L 83/04
See application file for complete search history.

(56) References Cited

U.S. PATENT DOCUMENTS 3,230,121 A 1/1966 Nitzche et al.
3,544,343 A * 12/1970 Lachman ..... C04B 35/10 264/1.21
4,598,106 A 7/1986 Utsugi
4,769,189 A 9/1988 Douden
5,944,621 A 8/1999 Tsujinaka et al.
6,153,294 A 11/2000 Patton et al.
6,197,099 B1 3/2001 Pearce
6,802,381 B1 10/2004 Koors et al.

FOREIGN PATENT DOCUMENTS

JP 06199282 A 7/1994

OTHER PUBLICATIONS

Machine Translation of JP 06199282A; 1994.*
Stachiw, J. D., "Pressure Resistance Ceramic Housings for Deep Submergence Unmanned Vehicles," Marine Technology Society Journal, 1990-06, p. 59-62, vol. 24, No. 2, USA.
Margolis, James M., "Elastomeric Materials and Processes," Handbook of Materials for Product Design, Third Edition, 2001, 6.81-8.82, McGraw-Hill, USA.
Definition of Ceramic, Hawley's Condensed Chemical Dictionary, 14th Edition, 2002, John Wiley & Sons, Inc., USA.
(Continued)

*Primary Examiner* — James C Yager
(74) *Attorney, Agent, or Firm* — Steven C. Tietsworth, Esq.

(57) ABSTRACT

A high pressure resistant flotation sphere includes a brittle fracture material macro-sphere of high elastic modulus and a shell of a low shear strength elastomeric material surrounding the macro-sphere. A high pressure resistant flotation material may be made of a plurality of macro-spheres embedded in syntactic foam or other matrix material, with each macro-sphere being encased in a shell of a low shear strength material that isolates each macro-sphere hydrostatically from the surrounding matrix.

14 Claims, 5 Drawing Sheets

(56) References Cited

OTHER PUBLICATIONS

Rich, Gerald M., et al, "Scoop—An Improved Submarine Cable Recovery System," OCEANS, p. 650-655, 1984, Morristown, New Jersey, USA.
Glass Spheres Glass Instrument Housing, Teledyne Benthos Inc.,2007, USA. http://www.benthos.com/PDS/glasspheres.pdf.
Norhiro Baba, Akira Nogami, Kouji Terasaki, Kenji Kawasaki; Yoshiharu, "Synthesis of Alumina Balloons Using a Microcapsulation Method", Journal of the Ceramic Society of Japan, vol. 106, Jan. 1998.
Weston, S., Stachiw, J., Merewether, R., Olsson, M. and Jemmott, G. "Alumina Ceramic 3.6 in Flotation Spheres for 11 KM ROV/AUV Systems." OCEANS 2005: In Proceedings of MTS/IEEE. (1):172-177, Sep. 2005.

* cited by examiner

FLOTATION DEVICES FOR HIGH PRESSURE ENVIRONMENTS

CROSS-REFERENCE TO RELATED APPLICATIONS

This application is a continuation-in-part of and claims priority to co-pending U.S. Utility patent application Ser. No. 12/483,140, entitled FLOTATION SPHERES EMBEDDED IN SYNTACTIC FOAM, filed on Jun. 11, 2009, which is a division of and claims priority to U.S. Utility patent application Ser. No. 11/220,500, entitled FLOTATION SPHERES EMBEDDED IN SYNTACTIC FOAM, filed on Sep. 7, 2005. The content of each of these applications is incorporated by reference herein in its entirety for all purposes.

FIELD

The present disclosure relates generally to flotation devices for use in underwater or other high pressure applications. More specifically, but not exclusively, the disclosure relates to flotation devices including a high elastic modulus brittle fracture material, such as in the form of hollow ceramic spheres, encased with low shear strength materials, such as an elastomeric shell or coating, to mitigate implosion failures under high pressures, such as in the deep ocean.

BACKGROUND

To support a payload while submerged, all underwater vehicles require buoyancy that is either provided by the pressure hull, floatation units attached to the hull, or both. Flotation units for manned deep submergence vehicles and remote autonomous (ROV) or autonomous underwater vehicle (AUV) systems must be capable of withstanding, in some cases, pressures at depths of 20,000 feet or more. In the past, flotation units for deep submersibles have been made from glass (a low elastic modulus material), steel, or ceramic spheres embedded in syntactic foam. The syntactic foam itself is a composite of plastic matrix such as epoxy and glass micro-spheres, which are typically micro-sized (e.g. the size of dust or other small particles).

The buoyancy of the syntactic foam is a function of the wall thickness of the glass micro-spheres and their packing density in the plastic matrix. The pressure resistance of the syntactic foam can be tailored by screening the glass micro-spheres for size and separation by density (wall thickness).

Syntactic foams have been developed for a wide range of ocean depths. The factor that limits their buoyancy is the packing density of the micro-spheres in the plastic matrix, which itself provides little, if any, buoyancy. By minimizing the volume of plastic matrix, the buoyancy of syntactic foam can be increased. This can be achieved by embedding relatively large glass or ceramic spheres with higher buoyancy than the foam itself. Larger spheres, hereinafter referred to as macro-spheres, provide more buoyancy than an equivalent volume of syntactic foam since the macro-spheres are not burdened with plastic matrix. Macro-spheres are typically an order of magnitude or two larger than micro-spheres (e.g., on the size of diameters in the inches or more). In the past, glass or ceramic macro-spheres have also been held in place in a framework made of plastic that is lighter than water.

Heretofore flotation units made of glass or ceramic macro-spheres embedded in syntactic foam have suffered from the problem that the macro-spheres have failed under pressures substantially lower than the pressures they can withstand when not embedded in the syntactic foam. Attempts to solve this problem by floating the macro-spheres in individual water filled chambers formed in the syntactic foam have been successful, but this approach involves an expensive fabrication process, and reduces the packing efficiency of the macro-spheres.

Accordingly, there is a need in the art to address the above and other-described problems.

SUMMARY

The present disclosure relates generally to flotation devices for use in underwater or other high pressure applications. More specifically, but not exclusively, the disclosure relates to flotation devices including a high elastic modulus brittle fracture material, such as in the form of hollow ceramic spheres, encased with low shear strength materials, such as an elastomeric shell or coating, to mitigate implosion failures under high pressures, such as in the deep ocean.

For example, in one aspect, the disclosure relates to a high pressure resistant flotation sphere. The flotation sphere may include, for example, a high elastic modulus brittle fracture material macro-sphere and a shell of a low shear strength material surrounding the macro-sphere.

In another aspect, the disclosure relates to a high pressure resistant flotation material, such as for use in deep ocean applications, made of a plurality of macro-spheres embedded in a syntactic foam. Each macro-sphere may, for example, be encased in a shell of a low shear strength material that isolates each macro-sphere hydrostatically from the surrounding matrix.

In another aspect, the disclosure relates to a method of fabricating a high pressure resistant flotation material. The method may include, for example, forming a plurality of glass or ceramic macro-spheres and encasing the macro-spheres in a non-liquid material capable of reverting to a liquid state. The method may further include the steps of embedding the encased macro-spheres in a syntactic foam material and causing the non-liquid material encasing the macro-spheres to revert to a liquid state.

In another aspect, the disclosure relates to a flotation device for use in high pressure environments, such as in the deep ocean. The flotation device may include, for example, a high elastic modulus brittle fracture material macro-sphere. The macro-sphere may have a compressive strength to tensile strength ratio of approximately four or greater. The flotation device may further include a shell or coating of a low shear strength material disposed around the macro-sphere.

In another aspect, the disclosure relates to a flotation device for use in high pressure environments, such as in the deep ocean. The flotation device may include, for example, a syntactic foam matrix. The flotation device may further include a plurality of high elastic modulus macro-spheres disposed within the matrix. The macro-spheres may include a seamless brittle fracture material ceramic sphere. The macro-spheres may be covered by a shell or coating of a transparent low shear strength elastomeric material.

Various additional aspects, details, features, and functions are further described below in conjunction with the appended Drawings.

BRIEF DESCRIPTION OF THE DRAWINGS

The present application may be more fully appreciated in connection with the following detailed description taken in conjunction with the accompanying drawings, wherein.

DETAILED DESCRIPTION OF EMBODIMENTS

Figure 2:
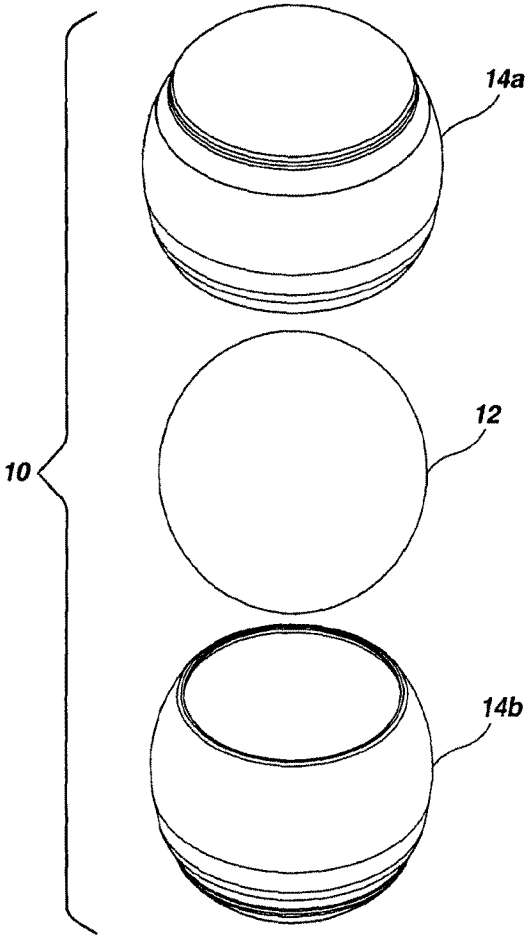
FIG. 2 is an exploded view of the high pressure resistant floatation sphere of FIG. 1 illustrating an internal macro-sphere and a two-piece outer shell of low shear strength material.

The present disclosure relates generally to flotation devices for use in underwater or other high pressure applications. More specifically, but not exclusively, the disclosure relates to flotation devices including a high elastic modulus brittle fracture material, such as in the form of hollow ceramic spheres, encased with low shear strength materials, such as an elastomeric shell or coating, to mitigate implosion failure under high pressures.

In accordance with one aspect, ceramic or other high modulus brittle fracture material macro-spheres may be encapsulated with a coating shell of low shear strength material, such as elastomeric or other low shear strength materials. These coated macro-spheres may then be embedded in syntactic foam matrix or other buoyant matrix to form flotation devices for use in high pressure environments, such as in the deep ocean. This configuration prevents uneven loads from being transferred to the macro-spheres from the matrix, thereby mitigating potentially catastrophic implosion under high pressures.

In another aspect, the disclosure relates to a high pressure resistant flotation sphere. The flotation sphere may include, for example, a high elastic modulus brittle fracture material macro-sphere and a shell of a low shear strength material surrounding the macro-sphere.

In another aspect, the disclosure relates to a high pressure resistant flotation material, such as for use in the deep ocean, made of a plurality of macro-spheres embedded in a syntactic foam. Each macro-sphere may, for example, be encased in a shell of a low shear strength material that isolates each macro-sphere hydrostatically from the surrounding matrix.

In accordance with another aspect, the disclosure relates to a method of fabricating a high pressure resistant flotation material, such as for use in the deep ocean. The method may include, for example, forming a plurality of glass or ceramic macro-spheres and encasing the macro-spheres in a non-liquid material capable of reverting to a liquid state. The method may further include the steps of embedding the encased macro-spheres in a syntactic foam material and causing the non-liquid material encasing the macro-spheres to revert to a liquid state.

In another aspect, the disclosure relates to a flotation device for use in high pressure environments, such as in the deep ocean. The flotation device may include, for example, a high elastic modulus brittle fracture material macro-sphere. The macro-sphere may have a compressive strength to tensile strength ratio of approximately four or greater. The flotation device may further include a shell or coating of a low shear strength material disposed around the macro-sphere.

The brittle fracture material may include, for example, a ceramic material. The ceramic material may be a technical ceramic. The technical ceramic may be a ceramic having an alumina content of approximately 96 percent or higher. The macro-sphere may be fabricated as a integral, seamless sphere or similar or equivalent shape. The macro-sphere may be seamlessly formed by slip-casting or other integral-shape forming techniques. The macro-sphere may include Al2O3. The macro-sphere may include 99.9% or more by weight of Al2O3. The macro-sphere may include a material having a modulus of elasticity of approximately 40,000,000 PSI or higher. The brittle fracture material may be another brittle fracture material such as a metallic or glass material. The macro-sphere may be a ceramic fired at a temperature of approximately 1400 degree Celsius or higher. The macro-sphere may have a diameter of approximately 3.6 inches or more. The ratio of shell or coating thickness to macro-sphere diameter may be in the range of approximately 10:1 to 30:1. The ratio of shell or coating thickness to macro-sphere diameter may be approximately 20:1.

The shell or coating may include, for example, a transparent material. The shell or coating may include a synthetic rubber material. The shell or coating may include a silicone rubber material. The shell or coating may be made or formed of a single piece or element. The shell or coating may be made or formed of a plurality of separate pieces or elements. The plurality of separate pieces or elements may be overlapping on the macro-sphere. The shell or coating may include a material having a low shear strength with a hardness between about Shore A 0.2 to Shore A 99 hardness.

The flotation device may further include, for example, a syntactic foam matrix. The case or shell and macro-spheres may be disposed within the matrix.

In another aspect, the disclosure relates to a flotation device, such as for use in the deep ocean. The flotation device may include, for example, a syntactic foam matrix. The flotation device may further include a plurality of high elastic modulus macro-spheres disposed within the matrix. The macro-spheres may include a seamless brittle fracture material ceramic sphere. The macro-spheres may be covered by a shell or coating of a transparent low shear strength elastomeric material.

In operation, compressive stresses in the foam may be transferred substantially uniformly to the coated macro-spheres in a near hydrostatic manner. Macro-spheres of high brittle strength and high modulus (such as, for example, ceramics having an elastic modulus in the range of approximately 40-70 PSI) may advantageously be used in various embodiments in conjunction with appropriate low shear materials. The degree of hydrostatic isolation depends on the softness of the coated shell as well as its thickness. The shell may be made of a soft synthetic rubber-like material or other suitable elastomeric material or other low shear material, which, in an exemplary embodiment, may be fully or partially transparent for visual inspection of the encased spheres and coated areas after manufacture. The shell coating also has the additional potential advantage of providing impact resistance during storage, transport, and/or handling of the macro-spheres before they are embedded into the syntactic foam.

In operation of traditional macro-sphere flotation devices, materials such as steel or glass (which is a low elastic modulus material, typically having an elastic modulus in the range of 8-12 million pounds per square inch or PSI) are used at higher pressures in syntactic foam matrices due to their flexibility, which reduces failure under high pressures. However, they may disadvantageously add weight and/or compress during operation, thereby reducing buoyancy. Brittle fracture materials (i.e., materials having a compressive strength greater than tensile strength, typical multiples or even orders of magnitude greater), such as technical ceramics, may advantageously compress less than traditional materials such as glass or steel, but are subject to sudden failure due to point stresses, which may be applied to the macro-spheres by the matrix during high pressure operation. A point stress can cause failure of one macro-sphere, which can then create a cascade of failures (also known as "sympathetic failure") of other macro-spheres through the flotation device. The energy released by a single failure can be similar to that of a hand grenade or other explosion, and can then cause other macro-spheres embedded in the matrix to implode, driving a sudden, catastrophic failure of the flotation device.

Figure 1:
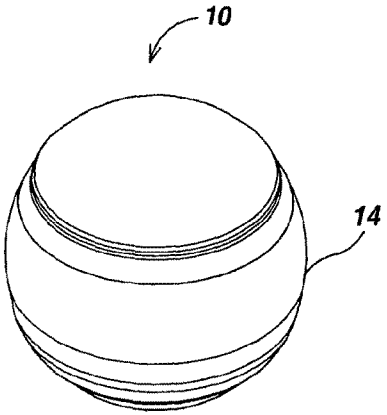
FIG. 1 is a perspective view of an embodiment of a high pressure resistant flotation sphere in accordance with certain aspects.
Figure 4:
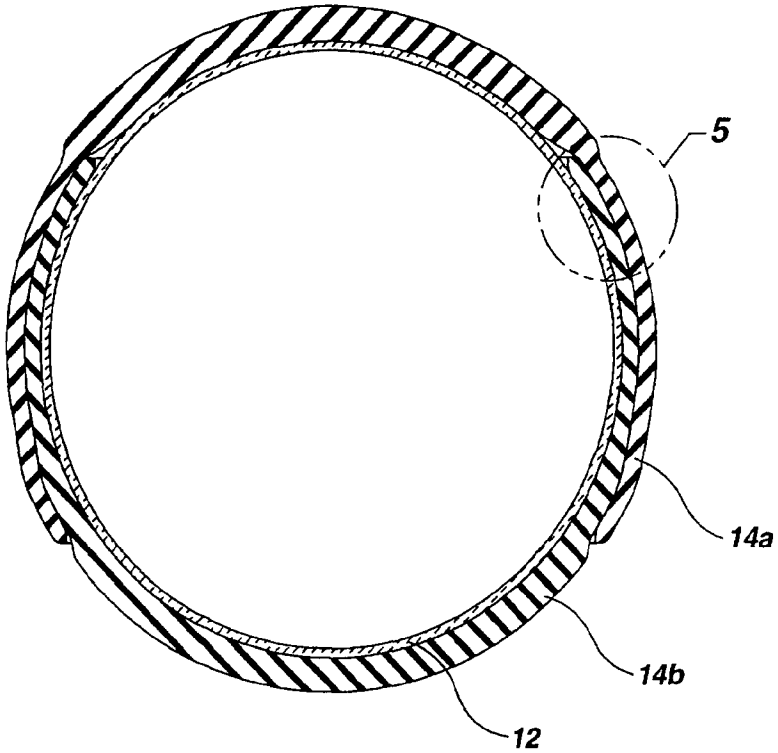
FIG. 4 is a cross-section view of the high pressure resistant floatation sphere embodiment taken along line 4-4 of FIG. 3.
Figure 3:
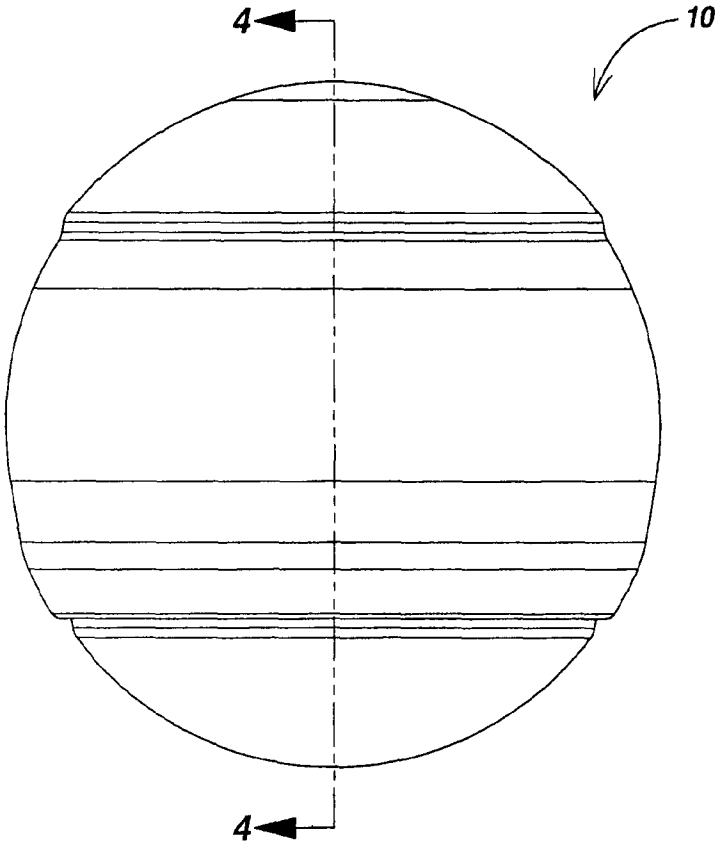
FIG. 3 is a side elevation view of the high pressure resistant flotation sphere embodiment of FIG. 1.
Figure 6:
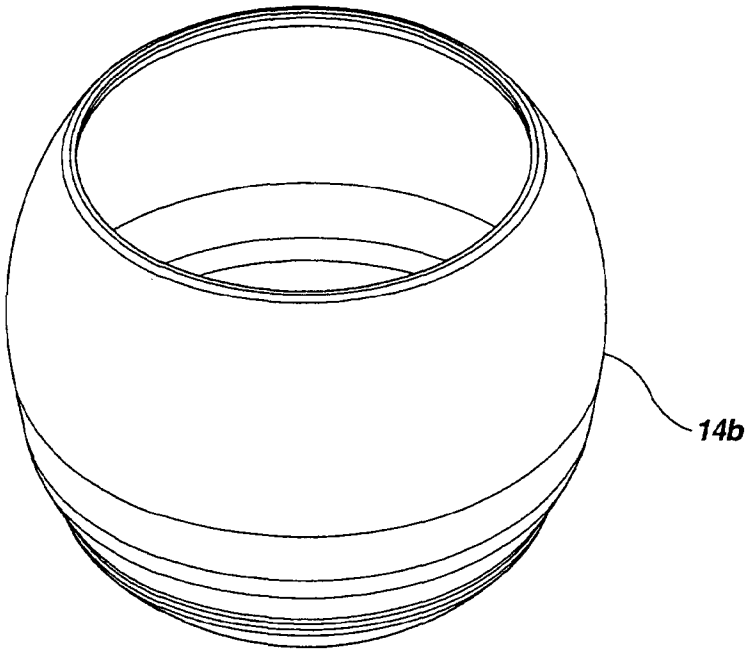
FIG. 6 is a perspective view of a boot that may form one half of the low shear strength shell of the high pressure resistant flotation sphere embodiment of FIG. 1.

Referring to FIG. 1, a high pressure resistant flotation sphere embodiment 10 includes a hollow macro-sphere 12 (FIG. 2) and a coating or shell 14 (FIG. 1) of an elastomeric material or other low shear strength material surrounding the macro-sphere 12. The macro-sphere 12 may comprise a brittle fracture material, such as a technical ceramic or other brittle fracture material in certain embodiments. Coating brittle-fracture macro-spheres with rubber or other elastomeric materials is counter-intuitive in these applications since it disadvantageously adds weight to the flotation devices, where weight reduction is a paramount criteria, and elastomeric materials may be subject to shrinkage under pressure. However, as described further below, reduction of point stresses applied to brittle fracture materials may be advantageously achieved using low shear strength materials to thereby mitigate against implosion and sympathetic failures, despite potentially introducing additional weight and/or having other disadvantages in such applications.

Returning to FIG. 1, in an exemplary embodiment, macro-sphere 12 may be made of a ceramic material, such as a technical ceramic. In an exemplary embodiment, a ceramic having approximately 99.9% by weight of $Al_2O_3$ fired in an oven at a suitably high sintering temperature, e.g., 1600 degrees C., may be used. Other brittle fracture materials may also be used for the macro-sphere 12, such as high alumina (e.g., 96 percent or higher) ceramics, which may be high fired (i.e., fired at 1400 degrees C. or higher), or other brittle fracture materials, such as various technical ceramics or other materials such as tungsten, diamond, polycrystalline materials, sapphire, and the like.

The time and temperature profile of the firing process and the precise composition of the ceramic can be adjusted to optimize strength in accordance with techniques and formulations well know to those skilled in the art of high strength ceramics. Those skilled in the art will be well familiar with the compositions and methods needed to fabricate suitable ceramic macro-spheres as well as glass macro-spheres. Various 1960's publications by Coors Porcelain Company of Golden Colo. describe slip cast ceramic spheres for deep water use. See also the publication "*The Structural Behavior of Glass Pressure Hulls*" by K. Nishida, Naval Ship Research and Development Center, June, 1972, the content of which is incorporated by reference herein. So called "high-firing," e.g., at temperatures of 1400 C or higher, may be used to fire ceramics for use as macro-spheres in various applications.

In general, it is desirable that the macro-sphere be formed to minimize weight while maintaining high compressive strength. In one embodiment, the hollow ceramic macro-sphere 12 may have a maximum wall thickness of 0.1 inches for low displacement and light weight. The ceramic macro-sphere 12 preferably has an outside diameter of at least 3.6 inches. To achieve maximum strength, the ceramic macro-sphere 12 should be seamless and should have a minimum deviation from perfect spherical shape and uniform wall thickness (e.g., by forming the macro-sphere as a single element rather than as two half spheres bonded together or other multi-piece constructions). These objectives may be achieved by rotomolding a suitable ceramic slurry in a random motion fashion inside well fitted plaster hemispheres while applying hot air to the outside of the hemispheres in order to produce a green (uncured) dry ceramic sphere for firing.

The low shear material shell 14 (FIG. 1) may be formed in a variety of ways. For example, the shell 14 may comprise two identical partially spherical boots 14*a* and 14*b* (FIGS. 2 and 6-8) that surround the macro-sphere 12 and overlap one another. The boots 14*a* and 14*b* may be pre-formed synthetic rubber-like pieces or other materials that are stretched over the macro-sphere 12. A preferred material for the boots 14*a* and 14*b* that form the shell 14 is a polyolefin elastomer material sold under the trademark VersaFlex, although persons skilled in the art will readily identify other suitable soft elastomeric (rubber-like) materials for various embodiments. VersaFlex materials, as well as many other appropriate macro-sphere coating materials, such as silicone rubber, are natively transparent. Use of these transparent materials for coatings may advantageously allow for inspection of macro-sphere coatings/shells to determine whether bubbles or other imperfections are present after fabrication. Conversely, if opaque materials are used, defects such as air bubbles, which can cause sudden, catastrophic failure, may be difficult or impossible to determine during inspection.

The material for the boots 14*a* and 14*b* that together comprise the shell 14 preferably should have a low shear strength with a hardness of between about Shore A 0.2 to Shore A 99 hardness, and more preferably, between about Shore A 0.4 to Shore A 98 hardness. Theoretically, any material with a Shore A hardness above zero should suffice as the coating for the macro-spheres 12. By way of example, the shell 14 may be made of the following (which is a non-exclusive list) materials: natural rubber, silicone rubber, isoprene, butadiene, styrene butadiene, butyl, ethylene propylene, nitrile, hydrogentated nitrile, epichlorohydrin, neoprene, Hypalon (trademark0, Tyrin (trademark), urethane, polysulfide, silicone, flurosilicone, tetraflouro-ethylene-propylene, polyacrylate, flourelastomer, Zalak (trademark), perfluoroelatomer, thermal plastic rubber (TPR), thermoplastic elastomer (TPE), Santoprene (trademark), Viton (trademark), Buna-N, EPDM and polyurethane.

Figure 5:
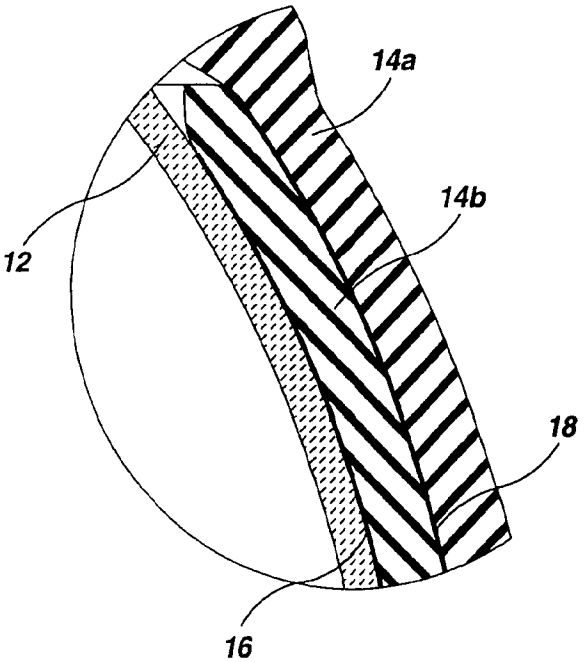
FIG. 5 is an enlarged view of the portion of the high pressure resistant floatation sphere embodiment inside the phantom line oval in FIG. 4.
Figure 8:
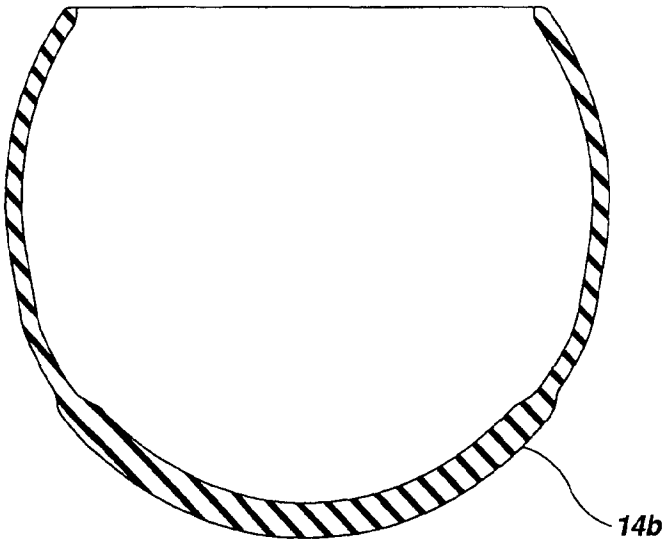
FIG. 8 is a sectional view of the boot of FIG. 6 taken along line 8-8 of FIG. 7.
Figure 7:
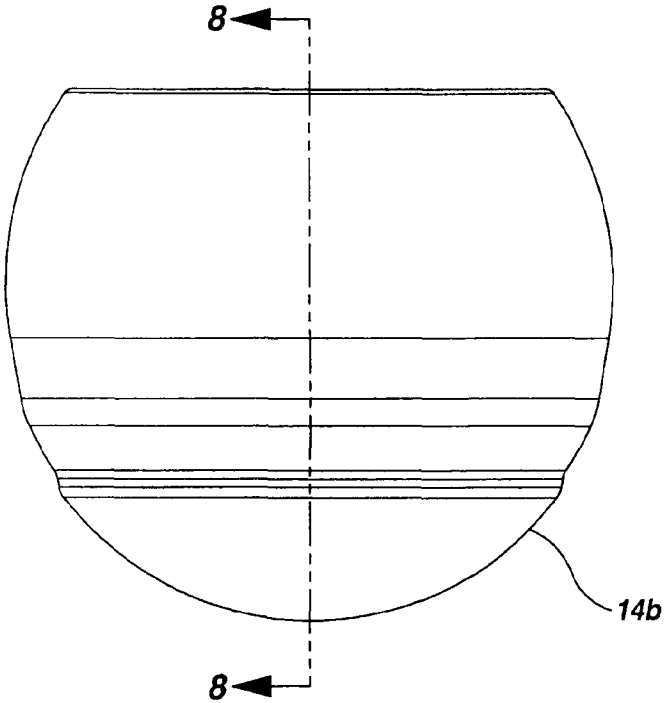
FIG. 7 is a side elevation view of the boot of FIG. 6.

As best seen in FIGS. 7 and 8, each boot, such as the boot 14*b*, covers approximately three-quarters of the macro-sphere 12. The boot 14*b* is first stretched and slipped over the macro-sphere 12. The other boot 14*a* is then stretched and slid over the macro-sphere 12 on the opposite side so that the boot 14*a* overlaps the boot 14*b*. As illustrated in FIG. 5, in order to eliminate trapped air bubbles, a first layer 16 of room temperature vulcanizing (RTV) silicone rubber may be applied between the macro-sphere 12 and the innermost boot 14*b*. The RTV silicone rubber may be one part or two part silicone rubber and/or other materials for use in sealing, and may be transparent in an exemplary embodiment. A second layer 18 of RTV may be applied between the innermost boot 14*b* and the outermost boot 14*a*. The RTV layers 16 and 18 may be used to fill any gaps between the innermost boot 14*b* and the macro-sphere 12 and between the boots 14*a* and 14*b*. The shell 14 is preferably injection molded, although it may be formed or coated in place by spraying, overmolding, or other techniques known or developed in the art for forming an outer rubber-like layer over an inner rigid structure.

Figure 9:
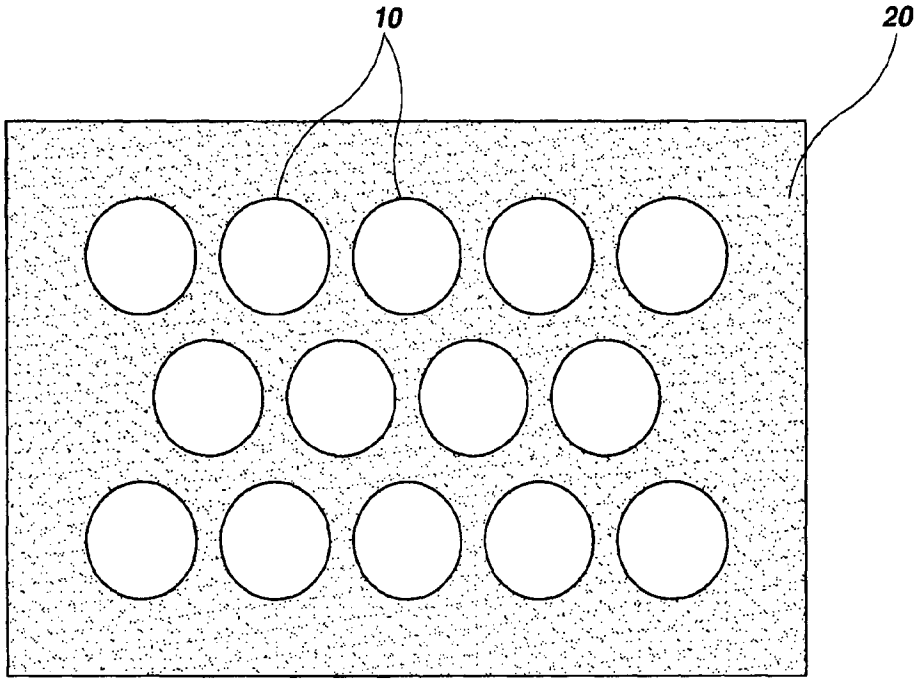
FIG. 9 is a sectional view of a high pressure resistant flotation device in accordance with certain aspects including a plurality of the high pressure resistant flotation spheres, such as those of FIG. 1, embedded in a syntactic foam matrix.

The shell 14 need not be fabricated as multiple parts, but could also be formed as a single unitary coating. The shell 14 may preferentially be made of a low shear strength material so that uneven loads are not transferred to the ceramic or glass macro-sphere 12 when the combination of the macro-sphere 12 and its surrounding shell 14 are embedded in syntactic foam 20 or other matrix materials (FIG. 9). Suitable syntactic foams are commercially available from various suppliers, such as Emerson Cumings Corporation, Floatation Technologies, Syntech Materials, Inc., and American Rigid Foam, among others. Any soft, compliant, low shear strength material can be used to coat the macro-spheres 12 so long as it substantially prevents non-uniform deformations of the surrounding syntactic foam 20 from causing uneven loading on the spheres 10, which may lead to point stresses and failure. The low shear strength shells 14 act to isolate the macro-spheres 12 hydrostatically from the surrounding matrix of the syntactic foam 20. As noted previously, the shell or coating may be transparent, fully or partially, to allow for visual inspection. Many of the listed materials are provided natively in a transparent form.

In alternate embodiments, the shell 14 may comprise suitable waxes or similar materials. The shell 14 may also be made of hot melt adhesive or RTV silicone rubber. One suitable hot melt adhesive is sold by 3M Company under the JetMelt trademark (Adhesive 3798-LM).

Flotation spheres comprising a 99.9% $Al_2O_3$ seamless ceramic macro-spheres encased in a 0.20 inch thick Versa-Flex low shear strength shell that have been fabricated in accordance with our invention have withstood proof testing to 30,000 PSI, one thousand hour sustained pressurization to 20,000 PSI, and one thousand pressure cycles to 20,000 PSI in the high pressure test facilities of DeepSea Power & Light, Inc., of San Diego, Calif. These test flotation sphere embodiments had an outside diameter of 3.6 inches with a 0.34 weight/displacement ratio, providing 0.6 pounds of lift. Encased in syntactic foam, these flotation spheres have the capability of providing the required lift for a hybrid remotely operated (HROV) submersible vehicle with 36,000 feet depth capability.

Although elastomeric materials may be used in exemplary embodiments, the isolating material use to make the shell 14 need not be elastic or elastomeric. Certain visco-elastic or plastic materials are also suitable. If the yield strength of the material is lower than a few hundred PSI or if its "creep modulus" on the scale of minutes is less than a few hundred PSI the material will still be able to keep the macro-spheres 12 separated in the molding process and also equalize stresses. Tar or bitumen is an example of a material that may be used to make the shell 14. A fast shear test or a fast hardness test can be used to judge whether the material is unacceptable. In general a low shear modulus, low shear strength, or low creep modulus material will suffice for the shell 14. Even a very high viscosity material such as Vistanex (trademark) elastomeric materials may be adapted to work in some embodiments.

Another alternative embodiment may utilize a material that either spontaneously reverts to a liquid state over a few days or one that can be triggered to revert. Ceramic or glass macro-spheres can be encased in a rigid polymer, such as a DGEBA (diglycidyl ether of bisphenol A) based epoxy loaded with catalysts such as copper or transition metal particles. This rigid epoxy system can be used to hold the ceramic or glass macro-spheres 12 in a particular orientation such as FCC, BCC, HCP, or simple cubic while the syntactic foam 20 is added to a mold. The metal particles will revert the adhesive to a semi liquid state within days and the macro-spheres 12 will be isolated from point loading by the semi-liquid resin. Such reversion is a well known process as shown by Section 3.8, *Resin Reversion in Contamination of Electronic Assemblies*, ISBN 0849314836, by Michael Pecht, Elissa M. Bumiller, David A. Douthit, Joan Pecht, Published by CRC Press, November 2002, which is incorporated by reference herein. This spontaneous reversion is also referred to as depolymerization. See for example, U.S. Pat. No. 5,229,528 entitled "Rapid Depolymerization of Polyhydroxy," the content of which is incorporated by reference herein.

Features can be molded into shell 14 surrounding each macro-sphere 12 to control the spacing and position of each flotation sphere 10 relative to its neighbors during encapsulation in the syntactic foam 20 matrix. For optimal packing efficiency in flotation device embodiments, a uniform spacing between the flotation spheres 10 is desirable, as illustrated in FIG. 9. Also it may be desirable to maintain a minimum spacing between adjacent flotation spheres 10 in order to prevent the failure (implosion) of one macro-sphere 12 from propagating within the body of flotation material and causing failure of adjacent macro-spheres 12.

While illustrative embodiments of novel floatation spheres and floatation material have been described, modifications thereof will be apparent to those skilled in the art. Therefore the protection afforded the invention should only be limited in accordance with the claims.

It is noted that the term "exemplary" as used herein means "serving as an example, instance, or illustration." Any aspect, detail, function, implementation, and/or embodiment described herein as "exemplary" is not necessarily to be construed as preferred or advantageous over other aspects and/or embodiments.

The scope of the present invention is not intended to be limited to the aspects shown and described previously herein, but should be accorded the full scope consistent with the language of the appended Claims and their equivalents, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c.

The previous description of the disclosed aspects is provided to enable any person skilled in the art to make or use the present invention. Various modifications to these aspects will be readily apparent to those skilled in the art, and the generic principles defined herein may be applied to other aspects without departing from the spirit or scope of the disclosure. Thus, the presently claimed invention is not intended to be limited to the aspects shown herein but is to be accorded the widest scope consistent with the appended Claims and their equivalents.

We claim:

1. A flotation device for use in high pressure deep ocean environments, comprising:

a high elastic modulus seamless brittle fracture ceramic material macro-sphere having a compressive strength to tensile strength ratio of approximately four or greater; and a shell of a transparent low shear strength elastomeric material surrounding the macro-sphere to transfer compression stresses in an adjacent foam material substantially uniformly to the macro-sphere, the shell comprising two symmetrical cover boots collectively completely surrounding the macro-sphere, wherein each individual cover boot covers about three-quarters of the macro-sphere, and wherein one cover boot partially overlaps another cover boot on the macro-sphere.

2. The flotation device of claim 1, wherein the ceramic is a technical ceramic having an alumina content of approximately 96 percent or higher.

3. The flotation device of claim 1, wherein the macro-sphere comprises $Al_2O_3$.

4. The flotation sphere of claim 3, wherein the macro-sphere comprises 99.9% or more by weight of $Al_2O_3$.

5. The flotation device of claim 1, wherein the macro-sphere comprises a material having a modulus of elasticity of approximately 40,000,000 PSI or higher.

6. The flotation device of claim 1, wherein the macro-sphere is formed by slip-casting so as to be seamless and substantially uniform in thickness.

7. The flotation device of claim 1, wherein the macro-sphere is fired at a temperature of approximately 1400 degree Celsius or higher so as to have one or more high-fired ceramic material properties.

8. The flotation device of claim 1, wherein the macro-sphere has a diameter of approximately 3.6 inches or more.

9. The flotation device of claim 1, wherein the ratio of shell thickness to macro-sphere diameter is in the range of approximately 10:1 to 30:1.

10. The flotation device of claim 9, wherein the ratio of shell thickness to macro-sphere diameter is approximately 20:1.

11. The flotation device of claim 1, wherein the shell comprises a synthetic rubber material.

12. The flotation device of claim 1, wherein the shell comprises a silicone rubber material.

13. The flotation device of claim 1, wherein the cover boots are injection molded over the macro-sphere.

14. The flotation device of claim 1, wherein the shell comprises a material having a low shear strength with a hardness between about Shore A 0.2 to Shore A 99 hardness.

* * * * *